US008927865B2

(12) United States Patent
Hanawa et al.

(10) Patent No.: US 8,927,865 B2
(45) Date of Patent: Jan. 6, 2015

(54) INSULATED WIRE

(75) Inventors: Hidehito Hanawa, Hitachi (JP); Hideyuki Kikuchi, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 326 days.

(21) Appl. No.: 13/412,117

(22) Filed: Mar. 5, 2012

(65) Prior Publication Data

US 2012/0247807 A1 Oct. 4, 2012

(30) Foreign Application Priority Data

Mar. 28, 2011 (JP) ..... 2011-069866

(51) Int. Cl.
*H01B 7/00* (2006.01)
*H01B 3/30* (2006.01)

(52) U.S. Cl.
CPC ..... *H01B 3/305* (2013.01); *H01B 3/306* (2013.01); *H01B 3/308* (2013.01)
USPC ..... 174/110 R; 174/36; 174/110 AR; 174/110 SR

(58) Field of Classification Search
CPC .... H01B 3/305; H01B 3/2813; H01B 3/0291; H01B 13/00; H01B 3/00; H01B 13/065; H01B 3/42; H01B 7/02; H01B 3/10; H01B 3/12; H01B 3/006; H01B 3/004; H01B 3/445; H01B 13/141; C08K 6/3415; C08K 3/36; C08K 7/24; C08K 2201/014; C08K 5/54; Y02T 15/04; Y02T 3/30; Y02T 3/34
USPC ..... 174/110 R, 110 SR, 120 R, 120 SR, 174/126.1, 126.2, 137 B; 428/383; 29/887
See application file for complete search history.

(56) References Cited

U.S. PATENT DOCUMENTS

| | | | | | |
|---|---|---|---|---|---|
| 4,546,041 | A | * | 10/1985 | Keane et al. | 428/372 |
| 4,681,928 | A | * | 7/1987 | Berger et al. | 528/353 |
| 4,716,079 | A | * | 12/1987 | Sano et al. | 428/383 |
| 4,801,501 | A | * | 1/1989 | Harlow | 428/383 |
| 5,219,657 | A | * | 6/1993 | Ueoka et al. | 428/379 |
| 5,281,766 | A | * | 1/1994 | Hildreth | 174/120 R |
| 5,350,638 | A | * | 9/1994 | Sawada et al. | 428/623 |
| 5,358,786 | A | * | 10/1994 | Ishikawa et al. | 428/380 |
| 5,362,925 | A | * | 11/1994 | Yamaguchi et al. | 174/120 R |
| 5,372,886 | A | * | 12/1994 | Inazawa et al. | 428/384 |
| 5,393,612 | A | * | 2/1995 | Matsuura et al. | 428/458 |
| 5,521,009 | A | * | 5/1996 | Ishikawa et al. | 428/375 |
| 5,965,263 | A | * | 10/1999 | Tatematsu et al. | 428/383 |
| 6,064,002 | A | * | 5/2000 | Hayami et al. | 174/564 |
| 6,288,342 | B1 | * | 9/2001 | Ueoka et al. | 174/137 B |
| 6,359,230 | B1 | * | 3/2002 | Hildreth | 174/110 R |
| 6,534,717 | B2 | * | 3/2003 | Suzuki et al. | 174/120 R |

FOREIGN PATENT DOCUMENTS

| | | |
|---|---|---|
| JP | 2000-331539 | 11/2000 |
| JP | 2004-204187 | 7/2004 |

* cited by examiner

*Primary Examiner* — William H Mayo, III
(74) *Attorney, Agent, or Firm* — Roberts Mlotkowski Safran & Cole P.C.

(57) ABSTRACT

An insulated wire includes a conductor, a partial-discharge-resistant layer formed on the conductor and including an insulating coating material including a base resin coating material and an inorganic fine particle dispersed in the base resin coating material, and an adhesion layer formed between the conductor and the partial-discharge-resistant layer and including an insulating coating material including the base resin coating material and an adhesion improver. A decrease rate in adhesion strength of the adhesion layer to the conductor after 20% elongation relative to that before the elongation is less than 25%.

9 Claims, 1 Drawing Sheet

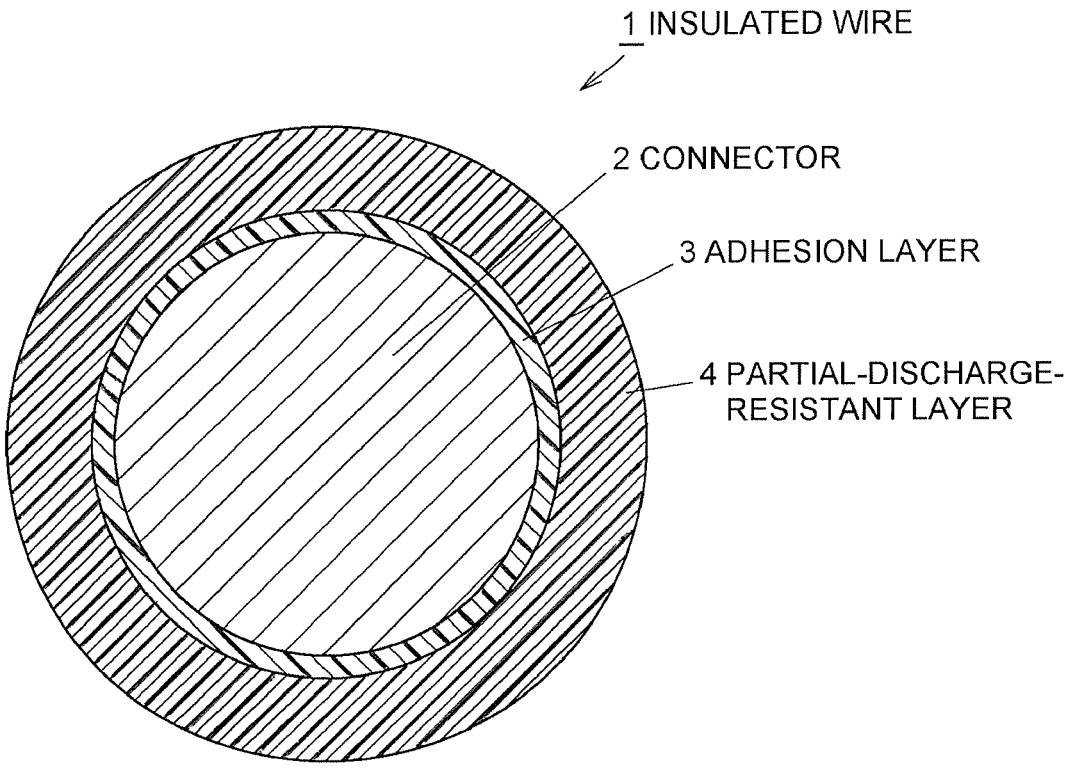
1 INSULATED WIRE
2 CONNECTOR
3 ADHESION LAYER
4 PARTIAL-DISCHARGE-
RESISTANT LAYER

INSULATED WIRE

The present application is based on Japanese patent application No. 2011-069866 filed on Mar. 28, 2011, the entire contents of which are incorporated herein by reference.

BACKGROUND OF THE INVENTION

1. Field of the Invention

The invention relates to an insulated wire (or enameled wire).

2. Description of the Related Art

Inverters are used as an efficient variable speed voltage controller in various electrical equipments. This type of inverter is controlled by a high-speed switching device in a frequency range of several KHz to several hundred KHz, and high surge voltage is generated when voltage is applied. The inverters in recent years can rise voltage rapidly especially by a high-speed switching device such as IGBT (Insulated Gate Bipolar Transistor), and instantaneous voltage up to twice the output voltage is generated as the surge voltage.

An enameled wire in which an insulating film (enamel film) is provided on a conductor is generally used as a material of a coil for electrical equipments using such an inverter. However, partial discharge may occur between the surfaces of the coiled enameled wire due to surge voltage, by which the enamel film is eroded. The erosion of the enamel film due to partial discharge eventually causes breakdown.

As a countermeasure against the influence of the surge voltage, it is desirable to use, e.g., a partial-discharge-resistant insulated wire (inverter-surge-resistant enameled wire) as is disclosed in, e.g., JP-A-2000-331539 and JP-A-2004-204187.

A conventional inverter-surge-resistant enameled wire has an enamel film formed around a conductor by applying and baking an organic/inorganic nanocomposite material thereon in which inorganic powder particles (silica, titania, alumina or zirconia, etc.) having a particle size of not more than 0.1 μm are dispersed in a polyamide-imide coating material or a polyester-imide coating material, etc., to be a base resin for enameled wire. An overcoat film for imparting mechanical strength, etc., is formed around the enamel film.

In such an enamel film, erosion thereof caused by partial discharge can be prevented. Note that, a nanocomposite is a composite material in which the dispersed inorganic power particles of not more than 0.1 μm are mixed to another material.

SUMMARY OF THE INVENTION

Recent electrical equipments such as motor are used at higher voltage than ever before and the technical specifications such as high-speed switching have become mainstream. In a process of forming a coil to be fitted into electrical equipments, an enameled wire is often used to form a coil under poor conditions in which an enameled wire itself is bent or twisted, in addition to a method of forming a coil by winding an enameled wire around a stator core.

Since the enameled wire is used under such poor conditions, larger stress than ever, such as tension, abrasion and bending etc., is applied to an insulating film of the enameled wire, and defects such as occurrence of cracks on an insulating coating or separation (film separation) of the insulating film from a conductor are thus likely to occur after being formed into a coil. There is concern that resistance to partial discharge (partial discharge resistance) may become lower than before being formed into a coil due to such occurrence of cracks on the insulating film or film separation after forming a coil.

Accordingly, it is an object of the invention to provide an insulated wire (or enameled wire) that has excellent partial discharge resistance even after being formed into a coil.

(1) According to one embodiment of the invention, an insulated wire comprises:

a conductor;

a partial-discharge-resistant layer formed on the conductor and comprising an insulating coating material including a base resin coating material and an inorganic fine particle dispersed in the base resin coating material; and an adhesion layer formed between the conductor and the partial-discharge-resistant layer and comprising an insulating coating material including the base resin coating material and an adhesion improver, wherein a decrease rate in adhesion strength of the adhesion layer to the conductor after 20% elongation relative to that before the elongation is less than 25%.

In the above embodiment (1) of the invention, the following modifications and changes can be made.

(i) The base resin coating material of the adhesion layer comprises a polyester-imide resin including an isocyanurate ring in a molecular chain.

(ii) The base resin coating material of the adhesion layer comprises a polyimide resin.

(iii) The insulated wire further comprises a tough polyamide-imide layer formed on the partial-discharge-resistant layer.

(iv) The insulated wire further comprises a lubricating polyamide-imide layer formed on the tough polyamide-imide layer.

(v) The adhesion improver comprises one of thiol compounds, mercaptans and aminothiazoles.

(vi) The adhesion layer is formed directly on the conductor and includes no inorganic fine particle.

(vii) The base resin coating material of the adhesion layer is different from that of the partial-discharge-resistant layer.

EFFECTS OF THE INVENTION

According to one embodiment of the invention, an insulated wire (or enameled wire) can be provided that has excellent partial discharge resistance even after being formed into a coil.

BRIEF DESCRIPTION OF THE DRAWINGS

Next, the present invention will be explained in more detail in conjunction with appended drawings, wherein:

FIG. 1 is a schematic cross sectional view showing an enameled wire in a typical embodiment of the present invention.

DETAILED DESCRIPTION OF THE PREFERRED EMBODIMENTS

Summary of Embodiment

An insulated wire in the embodiment of the invention has a conductor, a partial-discharge-resistant layer which is formed on the conductor and is made of an insulating coating material having inorganic fine particles dispersed in a base resin coating material and an adhesion layer which is formed between the conductor and the partial-discharge-resistant layer and is made of an insulating coating material having an adhesion improver added to the base resin coating material, wherein a decrease rate in adhesion strength of the adhesion layer to the conductor after 20% elongation is less than 25% relative to the adhesion strength to the conductor in a non-elongated state (i.e., the adhesion strength before the elongation).

The adhesion layer serves to adhere the partial-discharge-resistant layer having inverter surge resistance and the conductor. High adhesion strength is obtained by using the adhesion layer whose decrease rate in adhesion strength to the conductor after 20% elongation is less than 25% relative to the adhesion strength to the conductor without the elongation.

Embodiment

A preferred embodiment of the invention will be specifically described below in conjunction with the appended drawings.

Overall Structure of Insulated Wire

In FIG. 1, the reference numeral 1 denotes the entirety of an insulated wire. The insulated wire 1 is an enameled wire formed by repeatedly applying and baking an enamel coating material on an outer periphery of a conductor 2, and is provided with an adhesion layer 3 formed on the outer periphery of the conductor 2 and a partial-discharge-resistant layer 4 as an inverter-surge-resistant resin layer formed on the outer periphery of the adhesion layer 3. The conductor 2 is, e.g., a copper wire, an aluminum wire, a silver wire or a nickel wire, etc.

In the insulated wire 1, in addition to an insulating film composed of the adhesion layer 3 and the partial-discharge-resistant layer 4, a tough layer formed of a tough coating film for enameled wire is formed on the outer periphery of the partial-discharge-resistant layer 4 and a lubricating layer formed of a lubricating resin coating film for enameled wire is formed as an insulating film on the outer periphery of the tough layer, if necessary.

The tough layer is an interlayer for improving flexibility or heat resistance or for preventing the partial-discharge-resistant layer 4 from absorbing moisture, and is obtained by applying and baking a base resin coating material for enameled wire formed of, e.g., a polyamide-imide resin, etc. Meanwhile, the lubricating layer is a lubricating polyamide-imide overcoat layer as the outermost layer obtained by applying and baking a lubricating polyamide-imide coating material in which a lubricant is added to a resin coating material formed of a polyamide-imide resin. In this regard, when a polyamide-imide resin is used as a base resin of the partial-discharge-resistant layer 4, it is desirable that the interlayer formed on the outer periphery of the partial-discharge-resistant layer 4 be also formed of a polyamide-imide resin in light of prevention of decrease in adhesion, etc.

Structure of Adhesion Layer

The adhesion layer 3 as the lowermost layer is a fundamental structure of the insulated wire 1 in the present embodiment. The adhesion layer 3 is formed of a base resin for enameled wire. The base resin for enameled wire includes, e.g., a polyester-imide resin, a polyamide-imide resin and a polyimide resin, etc.

It is desirable that the insulated wire 1 have improved adhesion between the conductor 2 and the partial-discharge-resistant layer 4 to withstand the excessive winding stress. When an enamel (resin) coating material to which an adhesion improver is mixed is used as the adhesion layer 3 which is formed between the conductor 2 and the partial-discharge-resistant layer 4, an enamel film constituting the adhesion layer 3 is formed by applying and baking the coating material between the conductor 2 and the partial-discharge-resistant layer 4.

As for the adhesion layer 3, a decrease rate in adhesion strength between the adhesion layer 3 and the conductor 2 after 20% elongation of the enameled wire is preferably less than 25% relative to the adhesion strength therebetween without the elongation (i.e., the adhesion strength before the 20% elongation). When the decrease rate in adhesion strength of the adhesion layer 3 to the conductor 2 is not less than 25%, the separation of the insulating film may occur so as to cause deterioration in partial discharge resistance, hence, it is not preferable.

The thickness of the adhesion layer 3 at this time is preferably within a range of 10 to 35% of the total thickness of the insulating film composed of the adhesion layer 3 and the partial-discharge-resistant layer 4. When the thickness of the adhesion layer 3 is less than 10% of the total thickness of the insulating film, adhesion between the insulating film and the conductor 2 is lowered and the effect of suppressing the separation of the insulating film is reduced, hence, it is not preferable. On the other hand, when the thickness of the adhesion layer 3 is more than 35% of the total thickness of the insulating film, appearance defects may occur due to microbubble, etc., generated inside the adhesion layer 3 caused by heat history received from a manufacturing equipment at the time of forming the adhesion layer 3. There is a possibility that the appearance defects may cause the separation of the insulating film or may decrease adhesion of the insulating film.

It is preferable that the adhesion improver contained in the base resin for enameled wire for forming the adhesion layer 3 includes any one of thiol compounds, mercaptans or aminothiazoles represented by, e.g., the following general formulas (1) to (6). In the formulas, R is, independently, a hydrogen atom, an alkyl group having 1 to 4 carbon atoms or an SH group, and Ar is a divalent aromatic group (aryl group) wherein a carbon atom of an aromatic ring is bonded to S shown in the general formula (6) and a carbon atom adjacent to the carbon atom is bonded to N shown in the general formula (6).

(1)

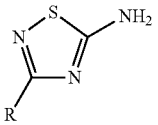

(2)

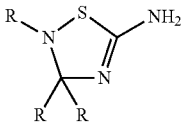

(3)

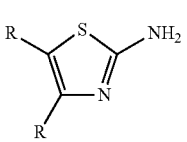

(4)

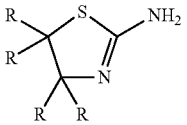

-continued (5)

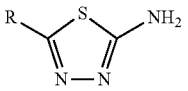

(6)

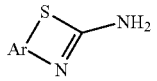

Meanwhile, when a resin coating material formed by mixing an adhesion, improver to a polyester-imide resin is used as the adhesion layer 3, it is possible to use commercially available resin coating materials such as, e.g., NH8640JH3Y (product name) and NH8640JH2Y (product name) manufactured by Totoku Toryo Co., Ltd. The content of adhesion improver is desirably within a range of not less than 0.1 parts by mass and not more than 10 parts by mass per 100 parts by mass of the base resin for enameled wire.

Structure of Partial-Discharge-Resistant Layer

The partial-discharge-resistant layer 4 suppresses erosion of the insulating film caused by inverter surge. The partial-discharge-resistant layer 4 is formed by applying and baking a partial-discharge-resistant insulating coating material on a surface of the adhesion layer 3. The partial-discharge-resistant insulating coating material is formed by dispersing organosol containing inorganic fine particles such as silica, alumina, titania or zirconia, etc., in a resin coating material composed of a base resin for enameled wire of polyamide-imide, polyimide or polyester-imide and a solvent.

The dispersion solvent for organosol is, e.g., a dispersion solvent consisting mainly of cyclic ketones having a boiling point within a range of 130° C. to 180° C. (main dispersion solvent). Such cyclic ketones include, e.g., cycloheptanone (boiling point: 180° C.), cyclohexanone (boiling point: 156° C.) and cyclopentanone (boiling point: 131° C.), etc. At least one or more thereof can be used. Alternatively, a cyclic ketone having a partially or entirely unsaturated cyclic structure, such as 2-cyclohexen-1-one, may be used.

In order to improve stability of organosol or an insulating coating material as a mixture of organosol with a resin coating material, the dispersion solvent may be a mixture of cyclic ketones with a solvent of N-methyl-2-pyrrolidone (NMP), N,N-dimethylformamide (DMF) or N,N-dimethylacetamide (DMAC), etc., an aromatic hydrocarbon or lower alcohol, etc. However, the higher the ratio of the mixed dispersion solvent other than the cyclic ketones is, the worse the affinity with a polyamide-imide resin coating material is. Therefore, it is desirable that not less than 70% of the total dispersion solvent in organo-silica sol be cyclic ketones.

The inorganic fine particles in organosol preferably has an average particle diameter of not more than 100 nm when measured by a BET method in order to efficiently exert partial discharge resistance of the insulating film. The average particle diameter of not more than 30 nm is more preferable in light of improvement in transparency of the organosol per se.

Organosol can be obtained by solvent, replacement of silica sol which is obtained by, e.g, hydrolysis of alkoxysilane or ion-exchange of water-glass. However, the manufacturing method of organosol is not limited thereto, and organosol may be manufactured by any known methods.

Effects of the Embodiment

In the insulated wire 1 configured as described above, adhesion strength of the insulating film is enhanced and an enameled wire is effectively obtained in which partial discharge resistance is less likely to decrease even after being formed into a coil to be fitted into, e.g., an electrical equipment compared to before being formed into a coil.

EXAMPLES

As a further specific embodiment of the invention, Example and Comparative Example will be described in detail below. It should be noted that this Example is a typical example of the embodiment and it is obvious that the present invention is not limited to the example.

Example 1

Firstly, a polyester-imide resin coating material in which a base resin for enameled wire formed of a polyester-imide resin and an adhesion improver are contained in a solvent (NH8640JH2Y manufactured by Totoku Toryo Co., Ltd.) was applied and baked on a copper wire having a conductor diameter of ϕ0.70 mm so as to have a thickness within a range of 2 to 8 μm, thereby forming an adhesion layer.

Next, a partial-discharge-resistant coating material, in which organo-silica sol containing a dispersion solvent formed of cyclohexanone and silica having an average particle diameter of ϕ50 μm is mixed to a resin coating material composed of a base resin for enameled wire formed of a polyester-imide resin and a solvent consisting mainly of γ-butyrolactone, was applied and baked on the adhesion layer formed of the polyester-imide resin coating material so as to have a thickness within a range of 23 to 27 μm, thereby forming a partial-discharge-resistant layer.

Then, a resin coating material formed of a polyamide-imide resin was applied and baked on the partial-discharge-resistant layer so as to have a thickness of 6 thereby forming a tough polyamide-imide resin layer.

Lastly, a lubricating polyamide-imide coating material formed by adding a lubricant to a resin coating material formed of a polyamide-imide resin was applied and baked on the tough polyamide-imide resin layer so as to have a thickness within a range of 3 to 5 μm, thereby obtaining an insulated wire (enameled wire) of Example 1.

Comparative Example 1

Comparative Example 1 is remarkably different from Example 1 in that a partial-discharge-resistant layer is formed directly on a copper wire as a conductor without forming an adhesive layer formed of a polyester-imide resin coating material.

In Comparative Example 1, firstly, a partial-discharge-resistant coating material, in which organo-silica sol containing a dispersion solvent formed of γ-butyrolactone and silica having an average particle diameter of 50 μm is mixed to a resin coating material composed of a base resin for enameled wire formed of a polyester-imide resin and a solvent consisting mainly of γ-butyrolactone, was applied and baked on a copper wire having a conductor diameter of 0.70 mm so as to have a thickness within a range of 25 to 27 μm, thereby forming a partial-discharge-resistant layer.

Then, a resin coating material formed of a polyamide-imide resin was applied and baked on the partial-discharge-resistant layer so as to have a thickness of 6 μm, thereby forming a tough polyamide-imide resin layer.

Lastly, a lubricating polyamide-imide coating material formed by adding a lubricant to a resin coating material formed of a polyamide-imide resin was applied and baked on the tough polyamide-imide resin layer so as to have a thickness within a range of 3 to 5 μm, thereby obtaining an insulated wire (enameled wire) of Comparative Example 1.

Characteristic Test

Tests of flexibility, adhesion strength, film separation and V-t characteristics were conducted on the enameled wire of Example 1 and that of Comparative Example 1 under the following conditions and these characteristics were evaluated. The results of the characteristic tests are summarized in Table 1 below.

Flexibility Test

In the flexible test (without elongation), an insulated wire without elongation was wound around a winding rod having a diameter 1 to 10 times greater than the conductor diameter of the insulated wire by a method conforming to "JIS C 3003, 7.1.1a, Winding", and a minimum winding rod diameter (d) at which occurrence of cracks on the insulating film is not observed by an optical microscope was measured. Meanwhile, in the flexible test (with 20% elongation), the insulated wire was elongated 20% by a method conforming to "JIS C 3003, 7.1.1a, Winding". After that, the test was conducted in the same manner as the flexible test (without elongation) and a minimum winding rod diameter (d) at which occurrence of cracks on the insulating film is not observed by an optical microscope was measured. The smaller the winding rod diameter without occurrence of cracks is, the more excellent the flexibility is.

Evaluation of Flexibility

As obvious from Table 1, in the enameled wires in a non-elongated state, the winding diameter without occurrence of cracks was self-diameter (1d) in both Example 1 and Comparative Example 1.

Meanwhile, in the enameled wire of Example 1 after 20% elongation, the winding diameter without occurrence of cracks was self-diameter (1d) and it was confirmed that flexibility was improved. In contrast, in the enameled wire of Comparative Example 1 after 20% elongation, the winding diameter without occurrence of cracks was (3d) which is three times greater the self-diameter (1d), and it was found that flexibility is poor.

Adhesion Strength Test

The adhesion strength test (without elongation) was conducted on the insulated wire without elongation in accordance with "JIS C 3003, 8.1b, twisting method" to measure the number of rotations (one rotation is 360°) at which the insulating film is separated from the conductor. The adhesion strength test (with 20% elongation) was conducted on the insulated wire with 20% elongation in accordance with "JIS C 3003, 8.1b, twisting method" to measure the number of rotations (one rotation is 360°) at which the insulating film is separated from the conductor. The larger the number of rotations until the enamel film is broken is, the more excellent the adhesion strength is.

Evaluation of Adhesion Strength

As obvious from Table 1, the number of rotations until the enamel film is broken is larger in Example 1 than in Comparative Example 1. Comparison between Example 1 and Comparative Example 1 revealed that the enameled wire of Example 1 has excellent adhesion strength. Note that, the decrease rate in adhesion strength of the adhesion layer to the conductor after 20% elongation is 21.3% relative to the adhesion strength without the 20% elongation in Example 1 and 33.8% in Comparative Example 1. That is, the decrease rate in adhesion strength in Example 1 is less than 25% and that in Comparative Example 1 is not less than 25%.

V-t Characteristic Test

Partial discharge resistance was evaluated by conducting a V-t characteristic (withstand voltage lifetime characteristic) test on the enameled wires in a non-elongated state and the enameled wires in a 20% elongated state. The V-t characteristic test was conducted using a twisted pair under measurement conditions of applied voltage of 1.4 kVp and sine wave of 10 kHz, and the time until breakdown was measured.

V-t Characteristic Evaluation

As obvious from Table 1, the time until breakdown is longer in Example 1 than in Comparative Example 1. Comparison between Example 1 and Comparative Example 1 revealed that the V-t characteristics of the enameled wire in Example 1 are excellent.

Comprehensive Evaluation of Characteristic Tests

From the overall results of the characteristic tests shown in Table 1, it is understood that the enameled wire of Example 1 is excellent in flexibility, adhesion strength, suppression of film separation, adhesion and V-t characteristics. Therefore, the enameled wire of Example 1 is applicable to a wound coil used in electrical equipments such as, e.g., inverter motor and electrical transformer, etc.

Although the embodiment and example of the invention have been described, the invention according to claims is not to be limited to the embodiment and example. Please note that not all combinations of the features described in the embodiment and example are not necessary to solve the problem of the invention.

TABLE 1

| Test items | | Example 1 | Comparative Example 1 |
|---|---|---|---|
| Flexibility | Without elongation | 1d | 1d |
| | With 20% elongation | 1d | 3d |
| Adhesion strength (the number of rotations) | Without elongation | 127 | 77 |
| | With 20% elongation | 100 | 51 |
| Decrease rate in adhesion strength (%) | | 21.3 | 33.8 |
| V-t characteristics (h) | Without elongation | 300< | 200 |
| | With 20% elongation | 150 | 20 |

Although the invention has been described with respect to the specific embodiment for complete and clear disclosure, the appended claims are not to be therefore limited but are to be construed as embodying all modifications and alternative constructions that may occur to one skilled in the art which fairly fall within the basic teaching herein set forth.

What is claimed is:

1. An insulated wire, comprising:

a conductor;

a partial-discharge-resistant layer formed around the conductor and comprising an insulating coating material including a base resin coating material and inorganic fine particles dispersed in the base resin coating material, the base resin coating material consisting essentially of polyamide-imide, polyimide or polyester-imide, the inorganic fine particles consisting essentially of silica, alumina, titania or zirconia; and an adhesion layer formed between the conductor and the partial-discharge-resistant layer and comprising an insulating coating material including the base resin coating material and an adhesion improver, wherein a decrease rate in adhesion strength of the adhesion layer to the conductor after 20% elongation relative to that before the elongation is less than 25%.

2. The insulated wire according to claim 1, wherein the base resin coating material of the adhesion layer comprises a polyester-imide resin including an isocyanurate ring in a molecular chain.

3. The insulated wire according to claim 1, wherein the base resin coating material of the adhesion layer comprises a polyimide resin.

4. The insulated wire according to claim 1, further comprising a tough polyamide-imide layer formed on the partial-discharge-resistant layer.

5. The insulated wire according to claim 4, further comprising a lubricating polyamide-imide layer formed on the tough polyamide-imide layer.

6. The insulated wire according to claim 1, wherein the adhesion improver comprises one of thiol compounds, mercaptans and aminothiazoles.

7. The insulated wire according to claim 6, wherein the adhesion improver includes any one of thiol compounds, mercaptans or aminothiazoles represented by general formulas (1) to (6) below, wherein R is, independently, a hydrogen atom, an alkyl group having 1 to 4 carbon atoms or an SH group, and Ar is a divalent aromatic group (aryl group) wherein one carbon atom of an aromatic ring is bonded to S shown in the general formula (6) and a carbon atom adjacent to the one carbon atom is bonded to N shown in the general formula (6)

(1)

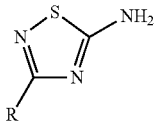

-continued (2)

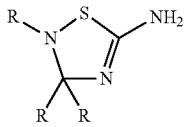

(3)

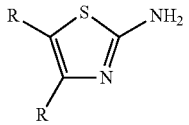

(4)

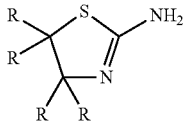

(5)

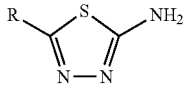

(6)

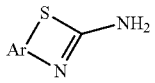

8. The insulated wire according to claim 1, wherein the adhesion layer is formed directly on the conductor and includes no inorganic fine particle.

9. The insulated wire according to claim 1, wherein the base resin coating material of the adhesion layer is different from that of the partial-discharge-resistant layer.

* * * * *